United States Patent [19]

Hornsby

[11] 4,121,598

[45] Oct. 24, 1978

[54] SMOKERS' PIPES

[76] Inventor: Jack Hornsby, 74 Park Crescent, Elstree, Herts., England

[21] Appl. No.: 806,346

[22] Filed: Jun. 14, 1977

Related U.S. Application Data

[63] Continuation of Ser. No. 612,553, Sep. 11, 1975, abandoned.

[30] Foreign Application Priority Data

Sep. 17, 1974 [GB] United Kingdom ..... 40448/74
Sep. 24, 1974 [GB] United Kingdom ..... 41480/74

[51] Int. Cl.[2] ..... A24F 1/22; A24F 1/32
[52] U.S. Cl. ..... 131/194; 131/204; 131/225; 131/230
[58] Field of Search ..... 131/194, 185, 222, 214, 131/230, 226, 204, 225, 196

[56] References Cited

U.S. PATENT DOCUMENTS

| | | | |
|---|---|---|---|
| 1,627,605 | 5/1927 | Homan | 131/204 |
| 2,581,169 | 1/1952 | Bugg | 131/194 |
| 2,718,892 | 9/1955 | Holdeaman | 131/204 |
| 2,746,459 | 5/1956 | Coble | 131/225 |
| 3,308,834 | 3/1967 | Furedy | 131/230 |
| 3,397,703 | 8/1968 | Otto | 131/204 X |

*Primary Examiner*—Stephen C. Pellegrino
*Attorney, Agent, or Firm*—Norris & Bateman

[57] ABSTRACT

A smoker's pipe comprising a stem unit incorporating the base of the bowl and formed of a plastics material and a bowl element detachably fitted to the bowl base portion and preferably formed of briar, the stem unit including the bowl base being internally metal lined. The pipe may include an externally fluted metal condenser plug in the bowl base and which plug may be integral with the bowl base lining.

5 Claims, 2 Drawing Figures

SMOKERS' PIPES

This is a continuation of application Ser. No. 612,553 filed Sept. 11, 1975 now abandoned.

Whilst briar (bruyere) is generally regarded as the most satisfactory material from which to form smokers' pipes, nevertheless Briar pipes of conventional type suffer from a number of disadvantages. For example, moisture generated by the burning tobacco collects at the bottom of the tobacco cavity of the bowl, together with saliva when the pipe is used by a "wet" smoker, and the base of the tobacco cavity becomes saturated. Attempts to overcome these disadvantages have included use of other materials particularly metals and plastics materials, but it has been found that plastics materials generally tend to crack or soften under the effect of the heat generated. The foregoing materials have in the majority of cases been used to form the stem unit to which is fitted a mouthpiece and detachable briar bowl.

In an endeavour to obtain a cool smoke under the conditions above mentioned it has been known to provide a metal plug in the base of the bowl portion of the stem unit upon which moisture generated by the burning tobacco condenses and this together with an excess of saliva introduced down the stem by the "wet" smoker quickly fills the cavity of the bowl portion of the stem unit and subsequently saturates the bottom of the briar bowl causing the briar to swell with the result that the holes leading into the stem unit become reduced in size and smoking becomes very difficult. Thus the smoker is caused to draw harder on the pipe, so generating an excess of heat, and the deterioration of the briar bowl becomes progressive. Known pipes fitted with such plugs have not retained all the condensed moisture and some has tended to flow along the stem into the smoker's mouth.

The present invention has as its broad object the provision of an improved smokers' pipe which will give a cool, dry and clean smoke. More particularly, the invention provides a manner of using plastics materials in the production of smokers' pipes which overcomes to a considerable extent the difficulties above mentioned by ensuring that the plastics material of the stem unit is at all times isolated from the smoke and by-products of the tobacco.

It is also an object of the invention to provide an improved form of condensor plug and a manner of incorporating it in a pipe stem which obviates the disadvantages previously associated with such plugs.

According to the invention a smokers' pipe comprises a stem unit incorporating the base of the bowl and formed of a plastics material and a bowl element detachably fitted to the bowl base portion of the said stem unit, the smoke passage in the stem and the inner face of the bowl base portion being provided with a metal lining preventing the generated smoke and tobacco by-products contacting the plastics material.

Preferably, a metal condenser plug is mounted in said bowl base portion and extends into an opening formed in the lower end of the bowl element, the walls of the said plug being axially grooved, fluted or corrugated, or the plug being externally of hexagonal or other polygonal shape. By forming the plug in this manner not only is its surface area increased, so increasing its capacity to condense water vapour, but it provides additional passage means for the flow of air and smoke to the pipe stem.

These and other features of the invention will be more fully understood from the following description of a preferred embodiment of the invention illustrated in the accompanying drawings, wherein.

Figure 2:
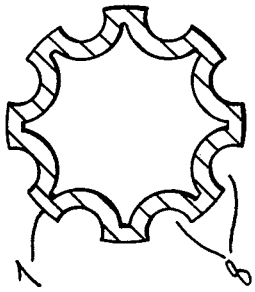
FIG. 2 is a cross section through the condenser plug on the line II—II of FIG. 1.
Figure 1:
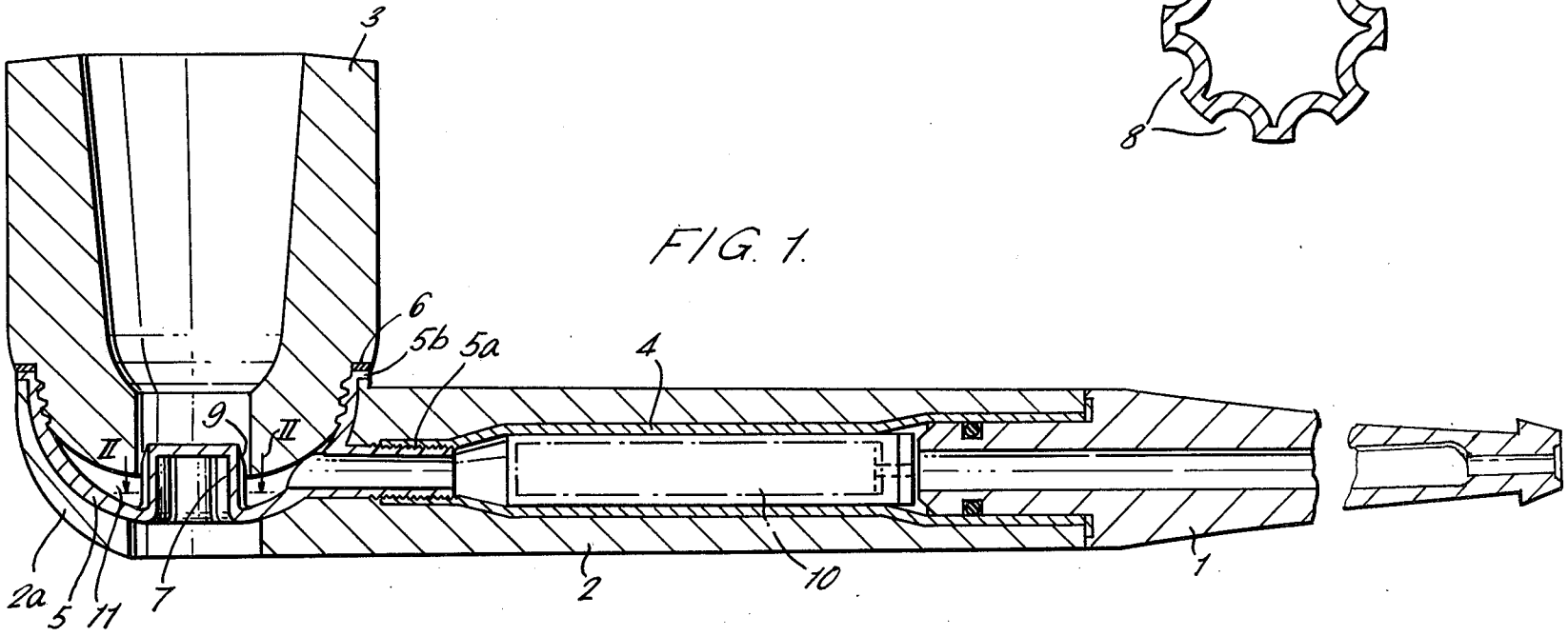
FIG. 1 is an axial section through the pipe.

The pipe shown comprises a mouthpiece 1, a stem unit 2 incorporating a bowl base portion 2a and a separate bowl element 3, the stem portion and the bowl base portion being moulded integrally of a plastics material. The bowl element 3 is preferably made of briar and is detachably connected to the bowl base, for example, by a multi-screw thread, the stem unit being grained and finished to simulate the briar of the bowl, although it may if desired be coloured or have any other desired finish. The smoke passage in the stem is lined by a tube 4 of aluminium or other suitable metal whilst the internal wall of the bowl base is similarly lined by an aluminium or like metal cup 5, said cup being formed with a spigot-like tubular extension 5a which is secured tightly to the metal tube 4, e.g. it may have a screwthread connection therewith as shown, it may be received with close fit within the end of the metal tube or it may embrace closely the end of this tube. The metal cup 5 and integral spigot 5a may be formed by die-casting or equivalent operation, the tube 4 and cup 5 being secured together before the stem unit is moulded around them. The screw thread by which the element bowl is united to the bowl base is formed on the metal cup which also has a peripheral flange 5b to sit upon the upper edge of the bowl base portion 2a, a sealing gasket 6 forming an airtight joint between the cup flange and a shoulder on the bowl element. Upstanding from the centre of the metal cup 5 is an integral hollow plug 7 which extends into an opening in the lower end of the detachable bowl and constitutes a condenser for moisture generated by the burning tobacco. The lower end of the detachable bowl element is spaced from the lower part of cup 5 such as to leave an annular chamber 11 around the condenser plug into which condensed moisture drains and is collected, the moisture being retained in this chamber at a level below the smoke passage in the stem. An important feature of the condenser plug is that its walls are formed with axially extending flutes or corrugations 8 whereby the surface area of the plug is increased to improve its condensing action. In use, smoke from the bowl flows around the plug where it extends into the opening in the bottom of the bowl element and hence to the passage in the stem. The fluting of the plug as above mentioned provides additional passages for the flow of this smoke and which passages cannot be readily clogged by the shrinkage of the hole in the bottom of the bowl element or the burning tobacco or ash. It will also be understood that the fluting above mentioned may be substituted by other forms of grooving or slotting, or by forming the exterior of the plug to an hexagonal or other polygonal shape, to achieve the same result.

Preferably that part of the plug located within the said opening is tapered as shown at 9 so enlarging the entrances to the passageways and further reducing the risk of clogging. The mouthpiece 1 may be formed of vulcanite, a hard plastics material, or any other suitable material, and includes a spigot portion which is received within the end of the stem. The metal lined bore of the stem unit is formed to accommodate a disposable silica gel or other type filter element 10 which is accessible for replacement when required by removal of the mouthpiece.

From the above description it will be seen that the smoke is not allowed to come into contact with any part of the pipe stem unit formed of a plastics material, whilst any moisture entrained in the smoke is extracted by the filter, thus ensuring a cool, clean, dry smoke. An important feature of the filter is that it will also absorb saliva introduced by the smoker and thus avoid flooding the chamber of the bowl base liner 5 which but for this would dampen the bottom of the bowl element and in turn wet the heel of the tobacco in the tobacco cavity of the said bowl element.

I claim:

1. A smoker's pipe comprising a stem unit made of non-metallic plastics material and integrally formed at one end with a cup-shaped bowl base, a metal bowl liner member within said bowl base, means on said bowl liner member providing a hollow lateral spigot-like extension open to the interior of said bowl liner member near the bottom of said bowl base, a metal stem liner tube secured at one end to said extension and extending within and through said stem unit for providing a continuous fixed metal lined smoke passage from the interior of said liner member through said stem unit, said stem unit being integrally moulded to said bowl liner member and around said extension and said stem liner tube, means providing a filter space within said tube, and a pipe bowl formed of briar detachably secured to said bowl liner member and having a bottom opening in communication with said interior of said bowl liner member, whereby smoke and other tobacco products pass from said bowl through said bowl liner member and extension and through the stem unit without contacting the plastics material of said stem unit.

2. The smoker's pipe defined in claim 1, wherein said bowl has a screw-threaded connection to said bowl liner member, and said bowl liner element has a peripheral flange tightly clamped between the bowl and the edge of said bowl base.

3. The smoker's pipe defined in claim 1, wherein the bottom of said bowl liner member is located sufficiently below the bottom of said bowl to define a condensate collection chamber therein at a level below said smoke passage.

4. The smoker's pipe defined in claim 1, wherein a metal bowl condenser plug projects up from the bottom of said metal liner member into the opening in the bottom of said bowl, said plug having an irregularly shaped periphery providing increased surface area to improve the condensating action.

5. The smoker's pipe defined in claim 1, wherein said stem unit is externally grained and finished to simulate the briar of said bowl.

* * * * *